US008019110B1

(12) United States Patent
Johnson

(10) Patent No.: US 8,019,110 B1
(45) Date of Patent: Sep. 13, 2011

(54) REMOVABLE HAT ATTACHING DEVICE FOR HOUSING AN ELECTRONIC DEVICE

(76) Inventor: Ben Edward Johnson, Fort Lauderdale, FL (US)

( * ) Notice: Subject to any disclaimer, the term of this patent is extended or adjusted under 35 U.S.C. 154(b) by 854 days.

(21) Appl. No.: 12/046,662

(22) Filed: Mar. 12, 2008

(51) Int. Cl.
*H04R 25/00* (2006.01)

(52) U.S. Cl. ..... 381/376; 381/381; 381/388

(58) Field of Classification Search ..... 381/301, 381/306, 311, 333, 366–367, 370–372, 374, 381/376, 381, 384, 388
See application file for complete search history.

(56) References Cited

U.S. PATENT DOCUMENTS

| | | | | |
|---|---|---|---|---|
| 3,629,522 | A * | 12/1971 | Richards | 381/388 |
| 4,776,044 | A * | 10/1988 | Makins | 381/376 |
| 5,115,472 | A * | 5/1992 | Park et al. | 381/376 |
| 2002/0131616 | A1 * | 9/2002 | Bronnikov et al. | 381/370 |

* cited by examiner

*Primary Examiner* — Suhan Ni
(74) *Attorney, Agent, or Firm* — Daniel S. Polley, P.A.

(57) ABSTRACT

A device for housing an electronic device and which is removably secured to a hat such as a baseball hat. The device includes a front portion and two arm portions, with the electronic device preferably secured to the front portion and a speaker member disposed near the end of each arm portion. Speaker wires running from the speakers to the electronic device can be hidden by disposed the wires within the arm portions. As the device is removable it can be easily and quickly removed from securement to a first hat for use with another hat. No modifications, alterations or adjustments to the hat are required for securing the device from one hat to another.

25 Claims, 6 Drawing Sheets

REMOVABLE HAT ATTACHING DEVICE FOR HOUSING AN ELECTRONIC DEVICE

1. FIELD OF THE INVENTION

The present invention relates generally to devices secured to a hat and more particularly to a removable hat attaching device for housing an electronic device that is secured to a "billed" style hat.

2. BACKGROUND OF THE INVENTION

Though devices have been secured to various types of hats, they are typically permanently secured and require the hat to be specially manufactured. Thus, the device cannot be easily detached from one hat and used with another hat. The present invention overcomes these problems.

SUMMARY OF THE INVENTION

The present invention is generally directed to a device that can be removably secured to a hat and particularly to billed style hats. The device preferably serves as a housing for an electronic device. As the device is removable it is thus interchangeable such that it can be easily and quickly removed from its securement to the first hat for use with another hat. No modifications or adjustments to the hat are required for securing the device from one hat to another.

The device preferably houses an electronic device, such as, but not limited to, one or more of the following a radio, MP3 player, cell phone, IPod, etc. which is preferably mounted to the device such that it is disposed underneath the bill area of the hat for easy access by the wearer without taking off his or her hat. The electronic device can be powered as conventionally known. In one embodiment, though not considered limiting, a solar panel can be mounted to the device such that it is disposed on the top surface of the bill area to receive solar energy. Thus, the solar panel can be used to power the electronic device and/or charge/recharge the batteries of the electronic device, through conventional solar powering technology. Alternatively, such area of the device could be used as a battery compartment. As a further alternative, the electronic device is powered internally or at some other location and the top area of the device can be used for advertisements or any other practical purposes.

A speaker is preferably attached to each side end of the device. Wiring from the electronic device to the speaker can be preferably embedded or otherwise disposed within each backward extending arm portion of the device and are thus preferably out of sight and with less of a chance of being caught or tangled with another object.

The device is preferably removably secured to the hat at three locations; a front area of the device and at two side locations. With use of the present invention, the user can removably secure the device with attached electronic device to a desired hat (i.e. baseball cap). If the user decides to wear a different hat or wants to lend the present invention device to another person, the device is easily removed from its current hat securement and simply reattached to the new hat. The present invention achieves all of its advantages without any modifications or altering of the conventional "billed" hat and without having to specially manufacture a hat to incorporate the present invention.

DETAILED DESCRIPTION OF THE PREFERRED EMBODIMENT

Figure 1:
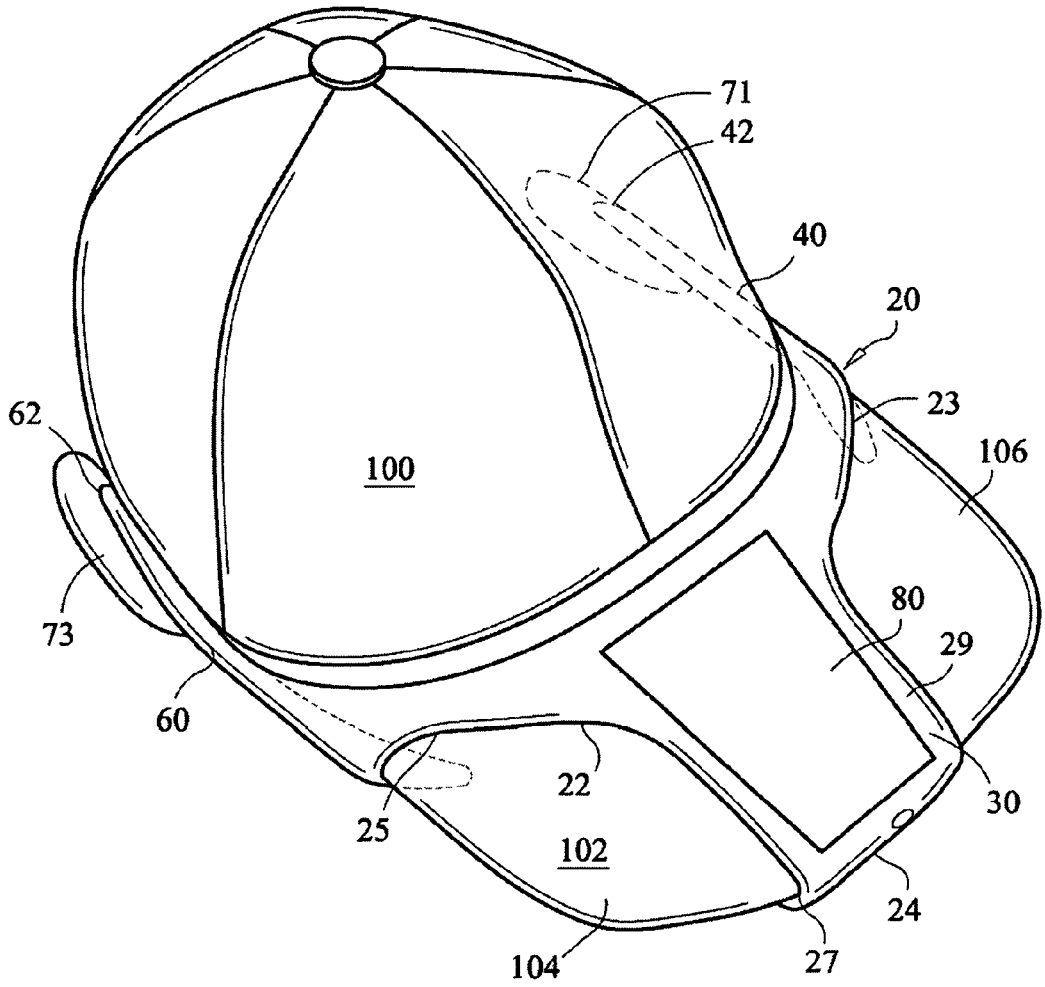
FIG. 1 is a perspective of a preferred embodiment of the present invention removably secured to a baseball cap.

As seen in FIG. 1, a removable hat attaching device for housing an electronic device is provided and generally designated as device 20. Device 20 is shown attached to a baseball hat or cap 100 having a bill portion 102. However, device 20 can also be removably secured to other "billed" hats, such as, but not limited to, a fishing hat, etc. As will be described in detail below, device 20 is removably secured to hat 100 and thus can be used with more than one hat by simply removing device 20 from one hat and resecuring device 20 to another hat.

Device 20 includes a frame or body member 22 having a front portion 24 and a first arm portion 40 extending backward from a first side 23 of front portion 24 and a second arm portion 60 extending backward from a second side 25 of front portion 24. When device 20 is secured to hat 100 in accordance with the present invention, first arm portion 40 terminates at its outer end 42 adjacent or approximate to a wearer's left ear location. Similarly, second arm portion 60 terminates at its outer end 62 adjacent or approximate to a wearer's right ear location.

Figure 2:
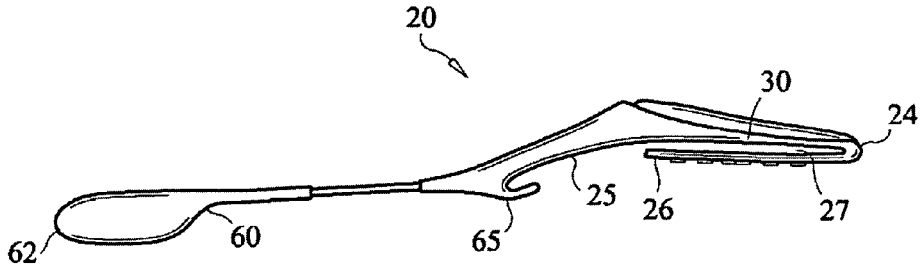
FIG. 2 is a side elevational view of the invention shown in FIG. 1.

Though not considered limiting, preferably front portion 24, first arm portion 40 and second arm portion 60 are constructed integral and/or monolithically formed as a one-piece frame or body member 22. Front portion 24 includes a preferably substantially "U" or "J"-shaped member defining a hat bill receiving 27 and a securement surface for an electronic device. Receiving area 27 serves as a front securement location of device 20 to hat 100. When device 20 is secured to hat 100 in accordance with the present invention, a lower member 26 (FIG. 2) of front portion 24 is positioned adjacent to a bottom surface 104 of hat bill portion 102 and an upper member 30 of front portion is positioned adjacent to a top surface 106 of hat bill portion 102.

Device 20 preferably houses an electronic device, such as, but not limited to, one or more of the following a radio, MP3 player, cell phone, satellite radio, GPS navigation, IPod, clock, thermometer, calculator, PDA, television, etc., as well as any combination thereof (all collectively referred to as "electronic device 103) which is preferably mounted to device 20 such that it is disposed underneath the bill or rim 102 area of hat 100 for easy access by the wearer without taking off hat 100 from the user's head. A light element can also be provided and integrated into device 20, such as at the lower member 26 of front portion 24 for providing light especially at night time. Accordingly, the light generated by the conventional light element can replace the user having to hold a flashlight or other lighting device and thus, freeing up the user's hands for other activities. The light can also be configured or contain a pivoting mechanism so that it is somewhat adjustable or movable and can be also preferably directed onto electronic device 103 to make viewing of the controls of electronic device 103 more visible at nighttime.

Electronic device 103 and/or light element can be powered as conventionally known. In one embodiment, though not considered limiting, a solar panel 80 can be mounted to frame 22 device such that it is disposed on the top surface of top or upper member 29 of front portion 24 and preferably adjacent to the top surface of bill 102 in order to receive solar energy. Solar panel 80 can be used to power the electronic device and/or light element, as well as used for charging/recharging the batteries of the electronic device/light element, through conventional solar powering technology. Other conventional circuitry, electronics, and/or power sources can also be used for running the electronic device and/or light and all are considered within the scope of the invention. Furthermore, other chargers can be used, such as, but not limited to, I-pod chargers, cell phone chargers, etc.

A base element can be provided on the bottom surface of frame 22 for locking in or otherwise connecting electronic device 103 to frame 22. However, other conventional connection mechanisms can be used for securing electronic device 103 to frame 22 and all are considered within the scope of the invention.

Alternatively, top member 29 can be used as a battery compartment. Conventional communication, such as, but not limited to, wiring, transmitters, receivers, antennas, etc. can be provided to provide communication between the power source and electronic device 103 and/or the light element.

As a further alternative, electronic device 103 and/or the light element can be powered internally or at some other location and top member 29 can be used for advertisements or any other practical purposes.

Figure 3:
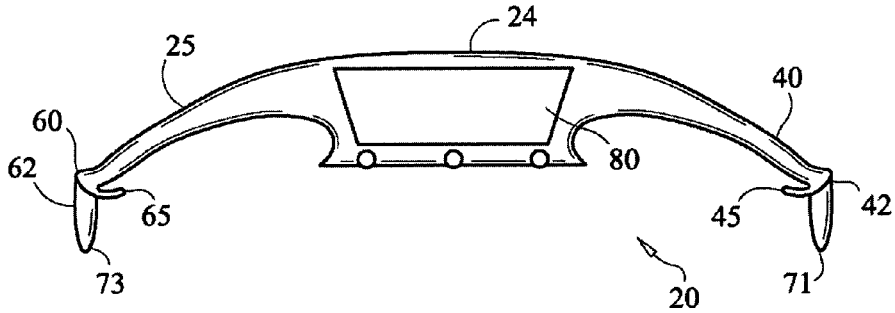
FIG. 3 is a front view of the invention shown in FIG. 1.

A first speaker 71 (See FIGS. 3 and 4) is preferably attached or disposed at or near end 42 of first arm and a second speaker 73 is preferably attached or disposed at or near second end 62 of second arm. A first speaker wire 75 (FIG. 4) from the electronic device to first speaker 71 can be preferably substantially embedded or otherwise substantially disposed within first arm 40. Similarly, a second speaker wire 77 from the electronic device to second speaker 73 can be preferably substantially embedded or otherwise substantially disposed within second arm 60. In this configuration, speaker wire 75 and 77 are preferably out of sight and with less of a chance of being caught or tangled with another object. Additionally, it is also within the scope of the invention that speaker 71 and speaker 73 can be wireless and communicate with electronic device 103 through conventional wireless technology.

Frame 22 is preferably removably secured to hat 100 at three locations; a front area of frame 22 created by the "U" or "J" shape of front portion 24 and at two side locations (clip 45 associated with first arm 40 and clip 65 associated with second arm 60). Preferably clip 45 is monolithically formed as part of first arm 40 and clip 65 is monolithically formed as part of second arm 60.

With use of the present invention, the user can removably secure device 20 with attached electronic device to a desired hat (i.e. baseball cap). If the user decides to wear a different hat or wants to lend device 20 to another person, device 20, with or without electronic device 103 secured thereto, is easily removed from securement to current hat 100 and simply reattached to the new hat. Device 20 achieves all of its advantages without any modifications or altering of the conventional "billed" hat 100 and without having to specially manufacture a hat to incorporate the present invention.

Frame 22 is preferably constructed from a plastic, rubber, silicone or other pliable material such that it can form to the hat 100 and to the wearer's personal physical features. As mentioned above, the electronic device(s) and/or light element(s) can run on a solar recharge for use, which may eliminate the need for batteries.

Thus the present invention preferably provides a portable device 20 that can be worn on a bill 102 of a hat 100 (i.e. baseball cap, fishing hat, etc.). Device 20 provides the user the opportunity to listen to music, television, or perform another activity, with their hat and without interference of speaker wires. In the preferred embodiment, the stereo or other electronic device can be preferably integrated into the frame of device 20, and preferably disposed or positioned at the bottom of the bill of a baseball cap for easy access for the user without having to remove the hat from the user's head.

As mentioned, along with electronic device 103, a light can be integrated into device 20 to allow the user to work hands-free in the dark, such as with nighttime use. In the preferred embodiment, device 20 is removably fastened at three locations to the hat, however additional or less securement locations can be used and are considered within the scope of the invention. The forward or front securement location can be the center of the hat rim and the other two securement locations can be on the left and right sides of the rim or bill portion of the hat. However, though not preferred, other locations can be selected on frame 22 for securing to the hat. This securement method allows device 20 to be easily interchanged for use with other hats as it is not permanently fixed to hat 100.

In a preferred embodiment, some or all of frame 22 can be constructed from a plastic, LATEX synthetic rubber, neoprene, and/or silicone, using a cold mold press. However, other materials can be used and all are considered within the scope of the invention. The clasp portions of frame 22 can also be constructed from a high grade plastic or neoprene. The clasps preferably have a little "give" (or can be slightly moved) to allow for securing the clasp to different hat bill sizes. The materials selected for frame 22, can allow the frame to form to the unique features of the hat and/or the unique features of the wearer, while at the same time permit reforming of frame 22 for hat and/or wearer changes.

Frame 22 can be preferably configured such that speakers 71 and 73 do not rest on the user's ears. Preferably, speakers 71 and 73 are disposed or rest next to the user's ears. Arm portions 40 and 60 can be fully adjustable or articulating by the material (i.e. memory) selected for frame 22 or through a pivoting or other adjusting mechanism incorporated into frame 22. By preferably not press speakers 71 and 73 into the user's ears, the user can still approaching hazards in the event he or she is walking around in traffic, riding a bicycle, etc. This preferred speaker position, also allows the user to carry on a conversation with somebody, while at the same listening to music.

One non-limiting example for device 20, is providing electronic entertainment fully capable of carrying MP3 radio, while also serving as an interface with a cell phone, such that the user would not have to have a cell phone receiver, and through voice animation the user could answer the phone calls for the cell phone and also continue with whatever he or she was doing. This again is merely one example for device 20 and the various uses are numerous and are all considered within the scope of the invention.

Figure 4:
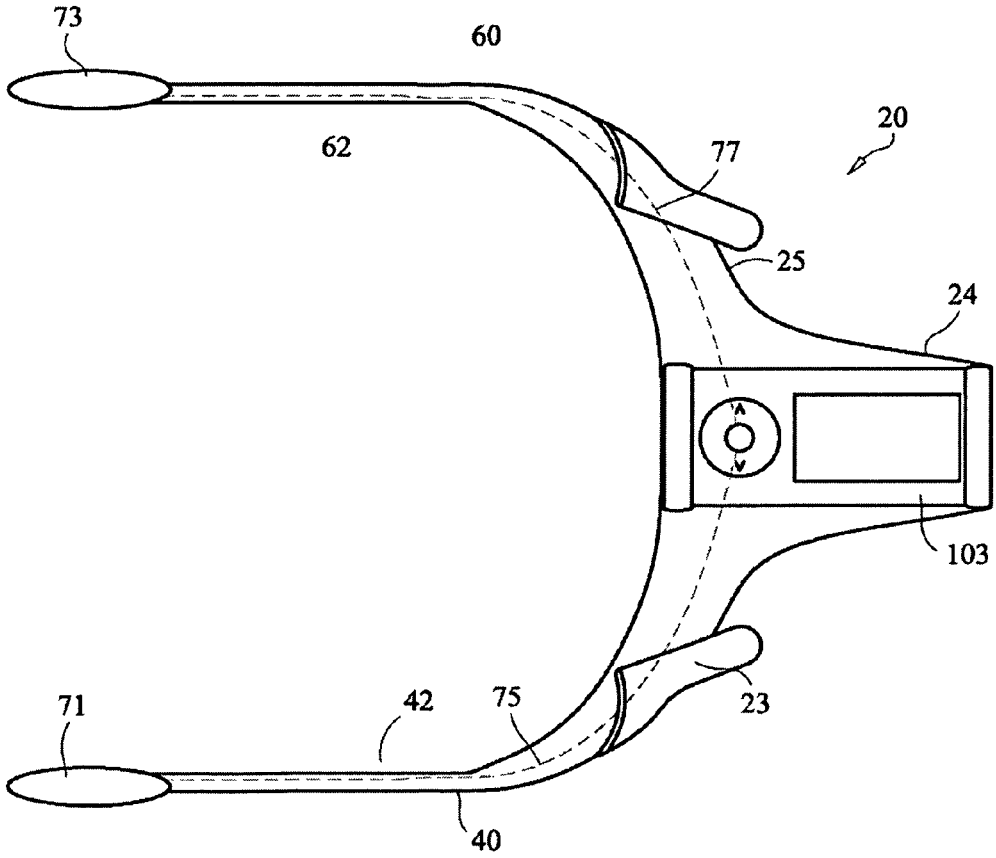
FIG. 4 is a bottom view of the invention shown in FIG. 1.
Figure 5:
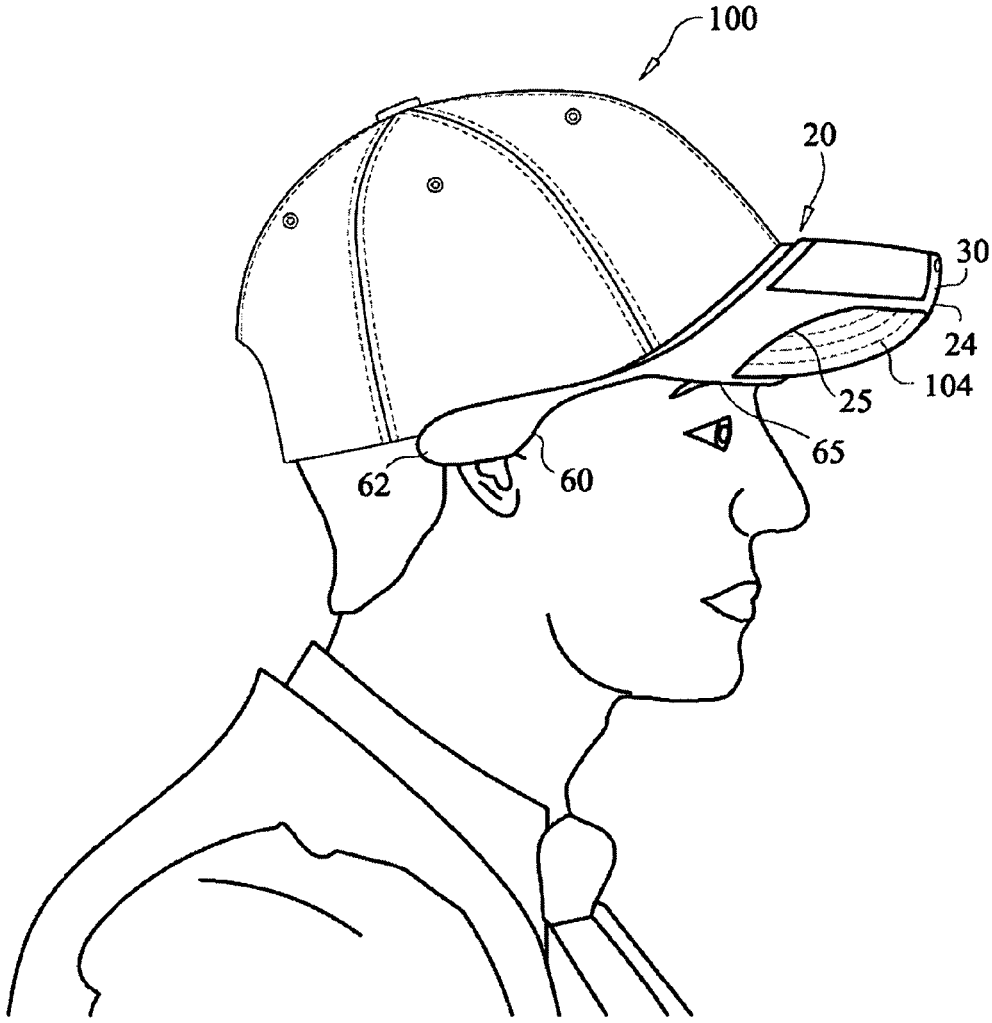
FIG. 5 is a side perspective view showing the invention of FIG. 1 secured to a baseball cap and being worn by a person.
Figure 6:
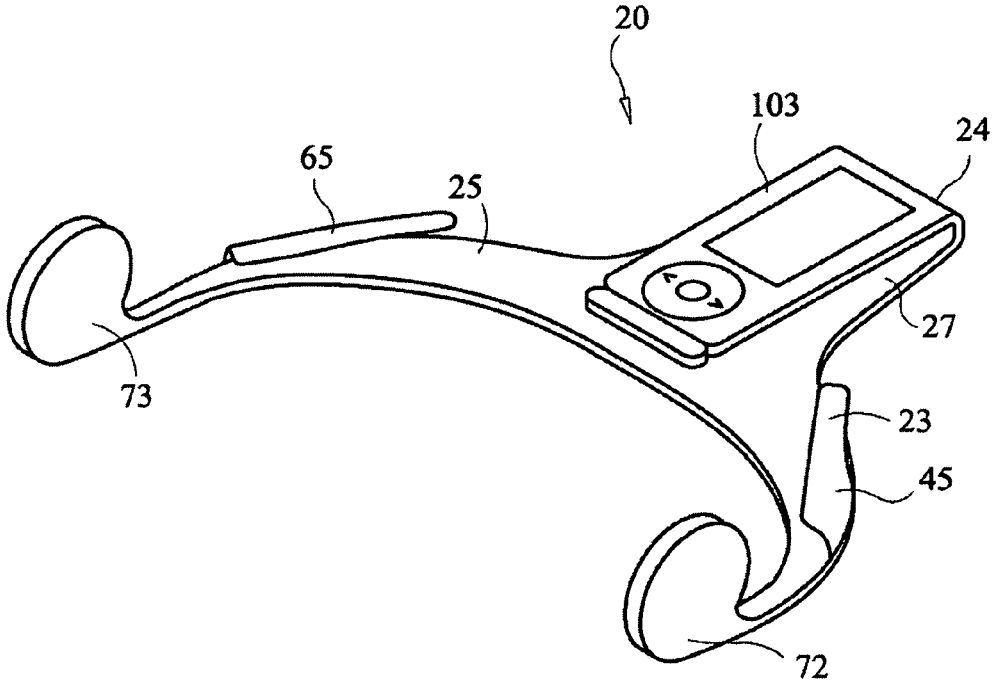
FIG. 6 is perspective bottom view of the invention shown in FIG. 1.
Figure 7:
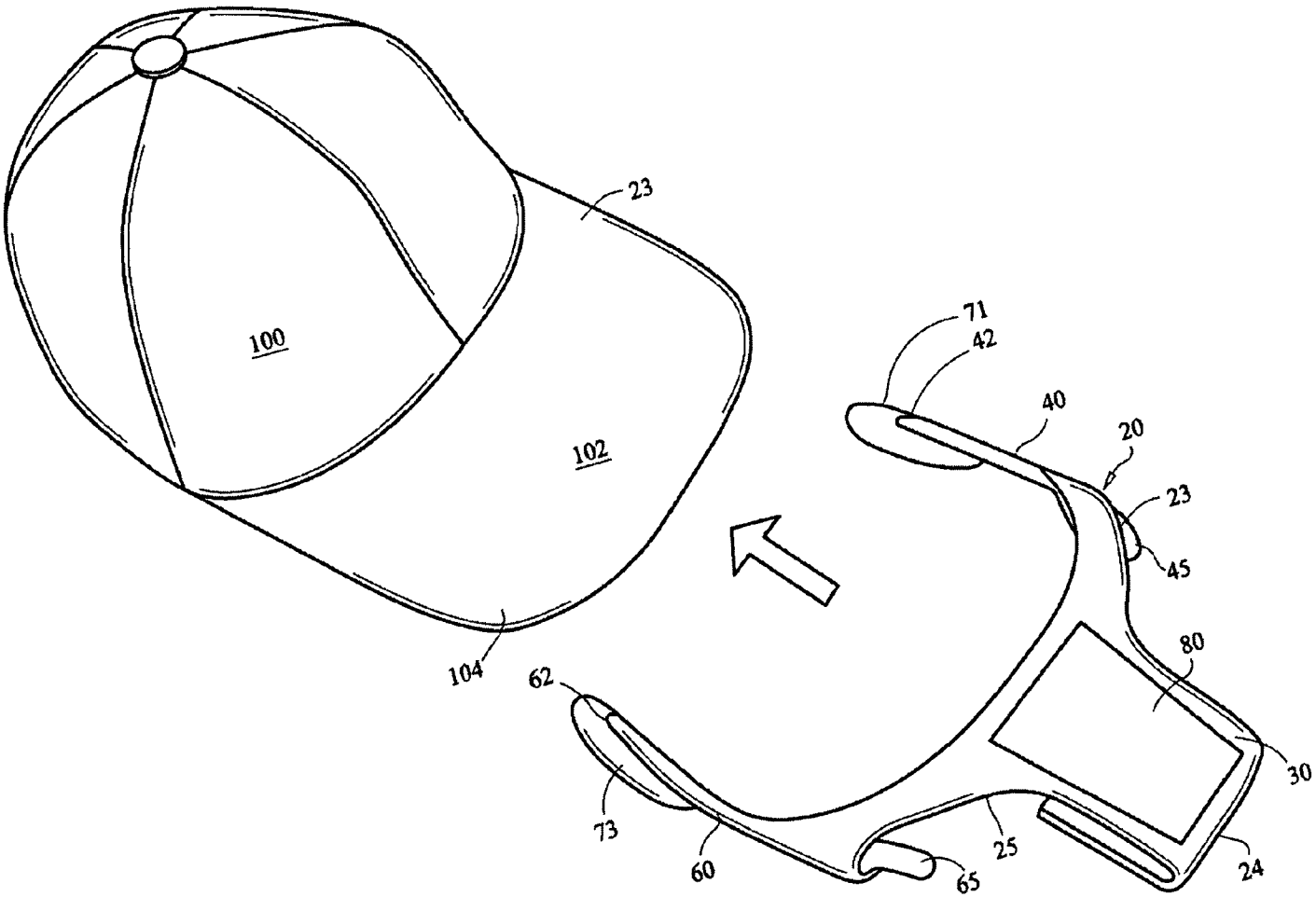
FIG. 7 is an exploded view showing the securement procedure for the invention of FIG. 1 to a baseball cap.

Any speaker wires can be preferably impregnated or disposed within frame 22, such that the wires are not visible and preferably out of the way. In this hidden embodiment, the wires would run internally within frame 22 from speakers 71 or 73 to electronic device 103 (FIG. 4). As mentioned above, the speaker arms can be fully articulating for adjusting the position of speakers 71 and 73. In one non-limiting embodiment, the pivoting or articulating can occur near the side clasps. The clasps are designed to grab onto to the hat, such that a certain amount of force is required to remove device 20 from the hat, so that the device will not unintentionally fall off. Furthermore, speakers 71 and/or 73 can also be detachable from their respective speaker arms.

Additionally, speakers 71 and/or speaker 73 can be located near electronic device 103 (and can also be internally disposed within frame 22 near electronic device 103). In this alternative embodiment, speaker arms 40 and 60 can be hollow or have a passageway with an open end near the user's ears. Thus, speaker arms 40 and 60 serve as sound tubes, which deliver the sound coming from speakers 71 and 73 (located near electronic device 103) to the user's ears.

The above described light element can be located at the front of frame 22 or on a portion of the bottom area of frame 22. Additionally, more than one light element can be provided and lights can be strategically placed at different locations along frame 22.

While the invention has been described and disclosed in certain terms and has disclosed certain embodiments or modifications, persons skilled in the art who have acquainted themselves with the invention, will appreciate that it is not necessarily limited by such terms, nor to the specific embodiments and modifications disclosed herein. Thus, a wide variety of alternatives, suggested by the teachings herein, can be practiced without departing from the spirit of the invention, and rights to such alternatives are particularly reserved and considered within the scope of the invention.

What is claimed is:

1. A device for housing an electronic device and adapted to be secured to a hat having a billed area, said device comprising a frame having a front portion, a first arm extending backward from a first side of said front portion and a second arm extending backward from a second side of said front portion;

a first speaker disposed at an outer end of said first arm;

a second speaker disposed at an outer end of said second arm;

wherein said front portion adapted having an electronic device mounted thereto;

wherein said frame adapted for removable securement to billed style hat.

2. The device of claim 1 wherein said front portion, said first arm and said second arm are monolithically formed as a one-piece frame member.

3. The device of claim 1 wherein the electronic device is in communication with said first speaker through a first speaker wire and with said second speaker through a second speaker wire.

4. The device of claim 3 wherein at least a majority portion of said first speaker wire is disposed within said first arm and hidden and at least a majority portion of said second speaker wire is disposed within said second arm and hidden.

5. The device of claim 1 wherein said front portion being substantially "U" or "J" shape and having a lower member and an upper member and defining a hat receiving area in between said lower member and said upper member.

6. The device of claim 5 wherein said electronic device adapted to be secured to the lower member of said front portion.

7. The device of claim 5 wherein a power member is adapted to be secured to the upper member of said front portion, wherein said power member providing power to said electronic device.

8. The device of claim 7 wherein said power member is a solar panel secured to the upper member and in communication with the electronic device.

9. The device of claim 1 further comprising a first means for removably securing the frame to a hat at a first side of said hat and a second member for removably securing the frame to a hat at the second side of said hat.

10. The device of claim 9 wherein said first means for removably securing is a first clip disposed at said first arm and said second means for removably securing is a second clip disposed at said second arm.

11. The device of claim 10 wherein said first clip is monolithically formed with said first arm and said second clip is monolithically formed with said second arm.

12. The device of claim 1 further comprising a light member disposed on said front portion.

13. The device of claim 7 further comprising a light member disposed on said front portion and powered by said means for powering.

14. A device for housing an electronic device and adapted to be secured to a hat having a billed area, said device comprising a one-piece frame having a substantially "U" shaped front portion monolithically formed with a first arm extending backward from a first side of said front portion and monolithically formed with a second arm extending backward from a second side of said front portion;

a first speaker disposed at an outer end of said first arm;

a second speaker disposed at an outer end of said second arm;

wherein said "U" shaped front portion having a lower member and an upper member defining a hat receiving area therebetween, said lower member adapted to having an electronic device mounted thereto;

wherein said frame adapted for removable securement to billed style hat.

15. The device of claim 14 wherein the electronic device is in communication with said first speaker through a first speaker wire and with said second speaker through a second speaker wire.

16. The device of claim 15 wherein at least a majority portion of said first speaker wire is disposed within said first arm and hidden and at least a majority portion of said second speaker wire is disposed within said second arm and hidden.

17. The device of claim 14 wherein a power member is adapted to be secured to the upper member of said front portion, wherein said power member providing power to said electronic device.

18. The device of claim 17 wherein said power member is a solar panel secured to the upper member and in communication with the electronic device.

19. The device of claim 14 further comprising a first clip disposed at said first arm for securing said first arm to the hat and a said second clip disposed at said second arm for securing said second arm to said hat.

20. The device of claim 19 wherein said first clip is monolithically formed with said first arm and said second clip is monolithically formed with said second arm.

21. A device for housing an electronic device and adapted to be secured to a hat having a billed area, said device comprising a one-piece frame having a substantially "U" shaped front portion monolithically formed with a first arm extending backward from a first side of said front portion and monolithically formed with a second arm extending backward from a second side of said front portion;

a first speaker disposed at an outer end of said first arm;

a second speaker disposed at an outer end of said second arm;

wherein said "U" shaped front portion having a lower member and an upper member defining a hat receiving area therebetween, said lower member adapted to having an electronic device mounted thereto;

wherein said frame adapted for removable securement to billed style hat;

a first clip monolithically formed with said first arm;

a second clip monolithically formed with said second arm;

wherein said hat receiving area defining a first securement point for said frame to a hat, said first clip defining a second securement point for said frame to the hat and said second clip defining a third securement point for said frame to the hat.

22. The device of claim 21 wherein the electronic device is in communication with said first speaker through a first speaker wire and with said second speaker through a second speaker wire.

23. The device of claim 22 wherein at least a majority portion of said first speaker wire is disposed within said first arm and hidden and at least a majority portion of said second speaker wire is disposed within said second arm and hidden.

24. The device of claim 21 wherein a power member is adapted to be secured to the upper member of said front portion, wherein said power member providing power to said electronic device.

25. The device of claim 24 wherein said power member is a solar panel secured to the upper member and in communication with the electronic device.

* * * * *